US010111009B2

(12) United States Patent
Schoeffmann et al.

(10) Patent No.: US 10,111,009 B2
(45) Date of Patent: Oct. 23, 2018

(54) FRAMELESS AUDIO TRANSDUCER FOR MOBILE APPLICATIONS INCLUDING OPTIONALLY SUPPORTED COIL WIRE AND LEADS

(71) Applicant: Sound Solutions International Co., Ltd., Beijing (CN)

(72) Inventors: Michael Schoeffmann, Baden (AT); Eric Klein, Himberg (AT); Helmut Wasinger, Hinterbruhl (AT)

(73) Assignee: Sound Solutions International Co., Ltd., Beijing (CN)

( * ) Notice: Subject to any disclaimer, the term of this patent is extended or adjusted under 35 U.S.C. 154(b) by 0 days.

(21) Appl. No.: 15/566,580

(22) PCT Filed: Apr. 14, 2016

(86) PCT No.: PCT/MY2016/050023

§ 371 (c)(1),
(2) Date: Oct. 13, 2017

(87) PCT Pub. No.: WO2016/167639

PCT Pub. Date: Oct. 20, 2016

(65) Prior Publication Data

US 2018/0124520 A1 May 3, 2018

Related U.S. Application Data

(60) Provisional application No. 62/147,760, filed on Apr. 15, 2015, provisional application No. 62/147,801, filed on Apr. 15, 2015.

(51) Int. Cl.

| | |
|---|---|
| ***H04R 1/02*** | (2006.01) |
| ***H04R 9/06*** | (2006.01) |
| ***H04R 9/04*** | (2006.01) |
| ***H04R 1/28*** | (2006.01) |

(52) U.S. Cl.
CPC ..... *H04R 9/06* (2013.01); *H04R 1/2803* (2013.01); *H04R 9/045* (2013.01)

(58) Field of Classification Search
CPC ..... H04R 1/2803; H04R 9/045; H04R 9/06; H04R 2499/11
See application file for complete search history.

(56) References Cited

U.S. PATENT DOCUMENTS

| | | | |
|---|---|---|---|
| 2012/0170791 | A1 | 7/2012 | Meng |
| 2012/0269377 | A1 | 10/2012 | Yuan |
| 2014/0241566 | A1 | 8/2014 | Choi et al. |

(Continued)

FOREIGN PATENT DOCUMENTS

| | | | |
|---|---|---|---|
| KR | 20100121771 | A | 11/2010 |
| WO | 2011027995 | A2 | 3/2011 |

*Primary Examiner* — Tuan D Nguyen
(74) *Attorney, Agent, or Firm* — Steven McMahon Zeller; Dykema Gossett PLLC

(57) ABSTRACT

A frameless audio transducer for mobile applications is provided. The invention relates to an audio transducer realized as speaker to transduce an electrical audio signal into acoustic sound or realized as receiver to transduce an acoustic sound into an electrical audio signal, which audio transducer is realized without a frame to align and fix the other parts of the audio transducer. The frameless audio transducer further includes coil lead support structures to reduce stress on the coil leads during operation.

20 Claims, 6 Drawing Sheets

(56) References Cited

U.S. PATENT DOCUMENTS

| | | | | |
|---|---|---|---|---|
| 2014/0355816 | A1* | 12/2014 | Jeong | H04R 1/00 381/433 |
| 2016/0157019 | A1* | 6/2016 | Tomas | H04R 9/025 381/400 |
| 2017/0048621 | A1* | 2/2017 | Wu | H04R 9/043 |
| 2017/0085992 | A1* | 3/2017 | Vitt | H04R 9/025 |
| 2017/0366888 | A1* | 12/2017 | Xiao | H04R 1/06 |
| 2018/0109879 | A1* | 4/2018 | Cai | H04R 9/06 |
| 2018/0124499 | A1* | 5/2018 | Li | H04R 1/24 |

* cited by examiner

FRAMELESS AUDIO TRANSDUCER FOR MOBILE APPLICATIONS INCLUDING OPTIONALLY SUPPORTED COIL WIRE AND LEADS

CROSS-REFERENCE TO RELATED APPLICATIONS

This application is a National Stage of International Application No. PCT/MY2016/050023, filed on Apr. 14, 2016, which claims priority to U.S. Provisional Application No. 62/147,760, filed on Apr. 15, 2015 and U.S. Provisional Application No. 62/147,801, filed on Apr. 15, 2015, all of which are hereby incorporated by reference in their entireties.

BACKGROUND OF THE INVENTION a. Field of the Invention

The invention relates to an audio transducer, such as a speaker to transduce an electrical audio signal into acoustic sound or a receiver to transduce an acoustic sound into an electrical audio signal. This invention furthermore relates to a micro speaker optimized for high acoustic output and located within a small volume of a mobile application like a mobile phone or a tablet or a gaming device or a notebook or similar applications. As the physical volume within these mobile devices is very limited and as the audio transducer has to fit into the housing of the mobile devices together with other modules having rectangular shapes, such a micro speaker quite often must have a rectangular form factor.

b. Background Art

WO 2011/027995A2 discloses a rectangular micro speaker for mobile applications. During production such a speaker is assembled using a frame having a hollow interior as a basis to align and fit together the other parts of the speaker. Such parts to be assembled onto the frame are a membrane, a coil, a magnet system comprising magnets, and a yoke to guide the magnetic flux through the coil. An electrical signal fed into the coil vibrates the membrane fixed to the coil in line with the electrical signal to generate acoustic sound.

A frame is typically realized as molded plastic and has to fulfill high quality standards to assemble the other parts of the speaker in exact relation to each other as calculated with the acoustic model to realize the speaker with maximal acoustic output. This high quality demand results in high production costs for the frame.

Furthermore, the frame is part of a so-called back volume of the speaker, which back volume is opposite the side of the membrane from which acoustic sound is emitted from the mobile device. The back volume has to enable airflow from the back volume side of the membrane to enable an undistorted vibration of the membrane according to the electrical signal fed into the coil. The frame has to be constructed in a way to enable this airflow which results in high development complexity or, in the absence of such complexity, lower quality of the emitted acoustic sound.

In addition to that, the frame takes up part of the mechanical volume within the mobile device reserved for the micro speaker. Other parts of the speaker have to be realized with less volume to fit the speaker into the mobile device which reduces the acoustic output of the speaker.

KR20100121771A discloses such a rectangular micro speaker for mobile applications with a coil fixed to a membrane of the speaker. The coil comprises two leads to feed an electrical signal into the coil arranged within the magnetic field of magnets to vibrate the membrane and generate acoustic sound in relation to the electrical signal. The speaker comprises a frame to align and fix the parts of the speaker, which frame holds a contact pad that has the function of an electrical interface between the coil and the audio electronics of the mobile device. As the coil vibrates with the membrane within the speaker and the contact pad is fixed within the frame, the mechanical stress of the two leads is problematic. This problem caused damage of the electrical contact between the audio electronics of the mobile device and the coil in a substantial percentage of devices in the market.

KR20100121771A teaches the use of a flexible printed circuit board (FPCB) between the leads of the coil and the contact pad. A FPCB known to one skilled in the art is built of several layers of material with a copper layer on top, which copper layer has to be etched to achieve a layer with plane electrical lines to connect the contact leads of the coil with the contact pad. A soldering process is used to connect the leads of the coil with the electrical lines of the FPCB and to connect the electrical lines of the FPCB with the contact pad. This solution helps to avoid damage of the electrical contact between the audio electronics of the mobile device and the coil, but disadvantageously increases the technical complexity and costs of the speaker substantially.

SUMMARY OF THE INVENTION

It is an object of the invention to realize an audio transducer for mobile applications without such disadvantages of known transducers. A new audio transducer for mobile applications in particular in a rectangular form factor avoids all such disadvantages and enables assembly and alignment the parts of the transducer without a frame.

It is another object of the invention to realize an audio transducer for mobile applications without such disadvantages of known transducers. A new audio transducer for mobile applications in particular in a rectangular form factor avoids such disadvantages with a direct connection of the leads of the coil with the contact pads and a support member or flexible foil fixed to the leads to mechanically support the leads of the coil.

One aspect of the invention is directed to an audio transducer having a membrane assembly, a coil assembly and a baseplate. The membrane assembly comprises a membrane having a top side, a bottom side and a periphery, and a ring plate assembly affixed to the periphery of the bottom side of the membrane. The ring plate assembly has two or more ring plate assembly mating elements. The coil assembly comprises a coil having a top side and a bottom side and a first lead and a second lead extending from the coil. The top side of the coil is affixed to the bottom side of the membrane. The coil assembly further includes a pair of contact pad assemblies, with each contact pad assembly having a body portion and a contact pad affixed to the body portion, wherein the body portion includes a first body mating element and a second body mating element. The baseplate has two or more baseplate mating elements. When assembled, the two or more ring plate assembly mating elements interface with the first body mating elements of the pair of contact pad assemblies, and the second body mating elements of the pair of contact pad assemblies interface with the two or more baseplate mating assemblies to align the membrane assembly, coil assembly, and baseplate.

Another aspect of the invention is directed to an audio transducer having a coil assembly, a support member and a contact pad. The coil assembly includes a coil having a top side and a bottom side and a first lead and a second lead extending from the coil. The leads of the coil are electrically connected to the contact pad. The support member includes support member portions which support each lead between the coil and the contact pads and/or support member portions which further support the coil. The support member may be affixed to the bottom side of the coil and the first and second leads.

Further details and advantages of such an audio transducer will become apparent in the following description and the accompanying drawings.

The foregoing and other aspects, features, details, utilities, and advantages of the present invention will be apparent from reading the following description and claims, and from reviewing the accompanying drawings.

BRIEF DESCRIPTION OF THE DRAWINGS

Further embodiments of the invention are indicated in the figures and in the dependent claims. The invention will now be explained in detail by the drawings. In the drawings:

Like reference numbers refer to like or equivalent parts in the several views.

DETAILED DESCRIPTION OF EMBODIMENTS

Various embodiments are described herein to various apparatuses. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It must be noted that, as used in this specification and the appended claims, the singular forms "a," "an" and "the" include plural referents unless the content clearly dictates otherwise.

The terms "first," "second," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

Figure 1:
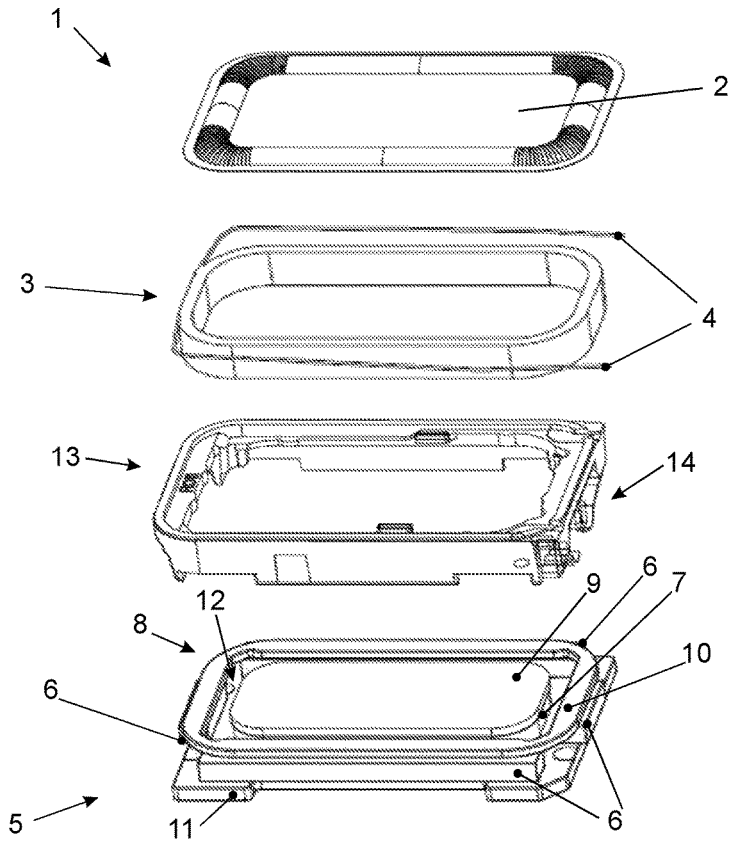
FIG. 1 shows an exploded perspective view of the relevant parts of a prior art rectangular micro speaker.
Figure 2A:
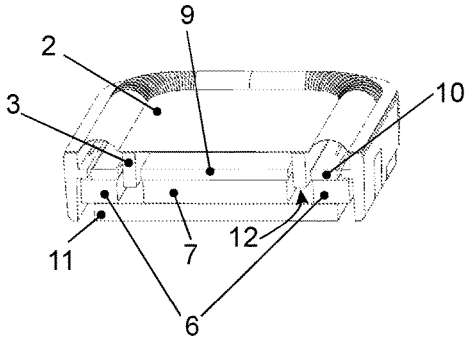
FIG. 2A shows a perspective sectional view and of the assembled speaker of FIG. 1.
Figure 2B:
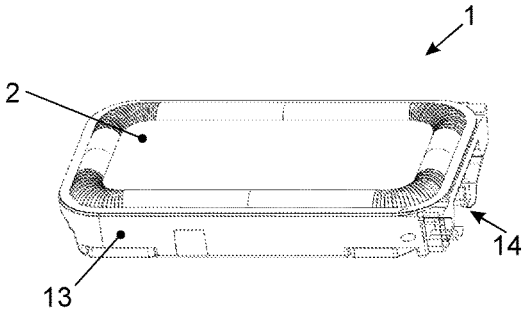
FIG. 2B shows a perspective side view of the assembled speaker of FIG. 1.

FIG. 1 shows an exploded perspective view of the relevant parts of a prior art rectangular micro speaker 1. FIG. 2A shows a perspective sectional view of speaker 1 and FIG. 2B shows a perspective side view of the assembled speaker of FIG. 1. Speaker 1 comprises a membrane 2 that is typically built out of several layers of material, such as Polyethereetherketone (PEEK) and/or Acrylat and/or Thermoplastic Elastomeric (TEP) and/or Polyetherimide (PEI) and may comprise a plate (not shown) to stiffen the membrane 2. Speaker 1 furthermore comprises a coil 3 with leads 4 to feed an electrical signal into coil 3. Coil 3 of assembled speaker 1, as shown in FIG. 2, is fixed to membrane 2 with e.g. glue.

Speaker 1 comprises a magnet system 5 with four magnets 6 arranged on the rectangular sides of the rectangular speaker 1 and a magnet 7 arranged in the center of speaker 1. Magnet system 5 furthermore comprises magnetic field guide 8 built of a top plate 9, fixed to magnet 7, and a ring plate 10, fixed to magnets 6, and a pot plate 11, fixed to magnets 6 on the side opposite to ring plate 10. Magnetic field guide 8 guides and focuses the magnetic field of magnets 6 and 7 in an air gap 12, into which air gap 12 coil 3 is arranged in the assembled speaker 1.

Prior art micro speaker 1 comprises a frame 13 to assemble and align membrane 2 with magnet system 5. Coil 3 fixed to membrane 2 fits into air gap 12. Frame 13 typically is realized as molded plastic to enable the complex surface with openings to enable airflow and fixation of further parts of speaker 1. Leads 4 of coil 3 are assembled into a contact pad, not shown in FIGS. 1 and 2, that is fixed in area 14 of frame 13.

Figure 3:
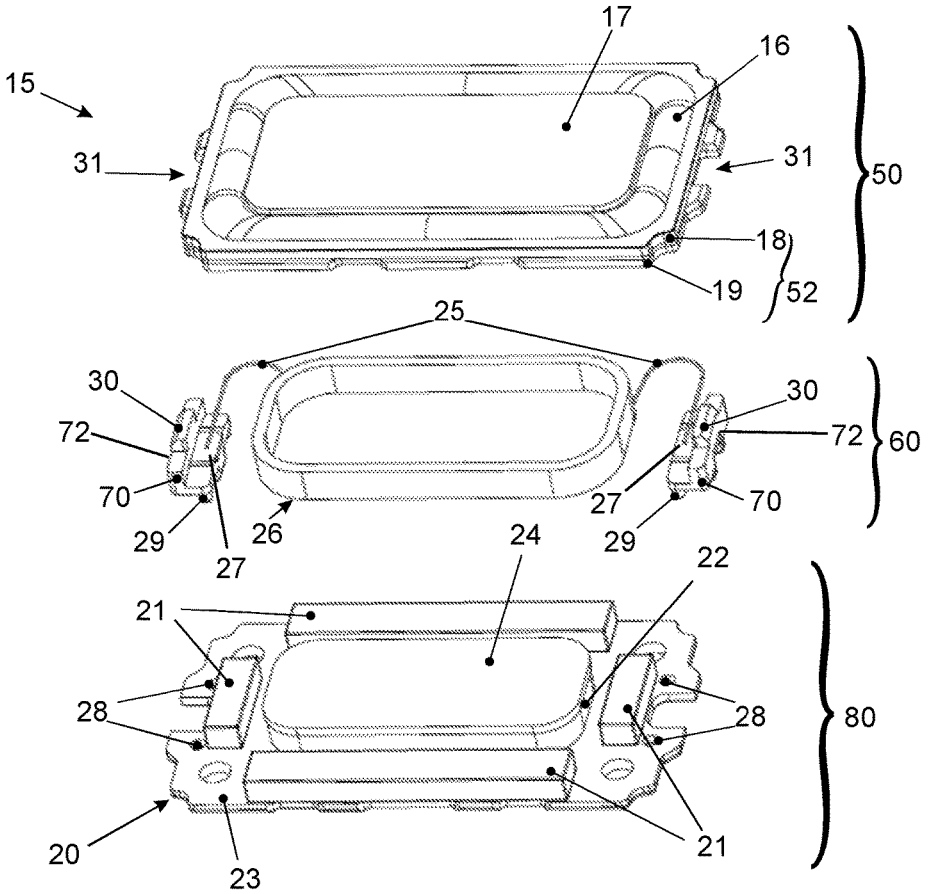
FIG. 3 shows an exploded perspective view of the relevant parts of a rectangular micro speaker according to a first embodiment of the invention.
Figures 4A, 4B:
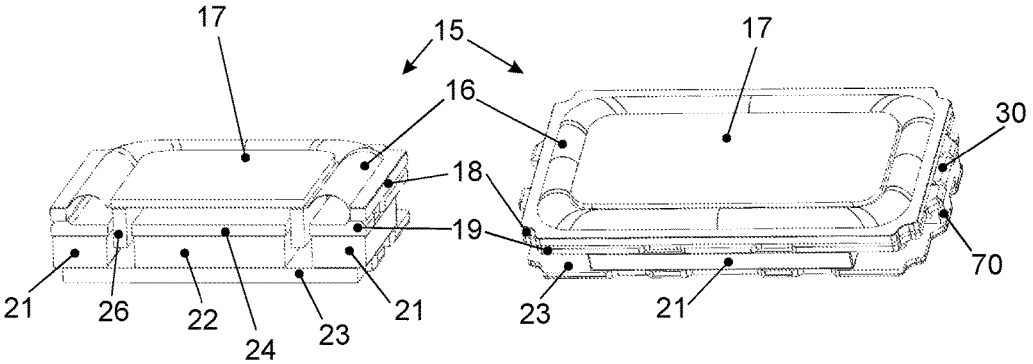
FIG. 4A shows a perspective sectional view of the assembled speaker according to the first embodiment of the invention shown in FIG. 3.
FIG. 4B shows a perspective side view of the assembled speaker according to the first embodiment of the invention shown in FIG. 3.

FIG. 3 shows an exploded perspective view of the relevant parts of a rectangular micro speaker 15 according to a first embodiment of the invention. FIG. 4A shows a perspective sectional view and FIG. 4B shows a perspective side view of the assembled speaker 15 of FIG. 3. Speaker 15 is realized without a frame and its parts are aligned and assembled as follows.

Speaker 15 comprises a membrane assembly 50, a coil assembly 60, and a baseplate assembly 80. The membrane assembly 50, coil assembly 60 and baseplate assembly 80 each include mating elements, as described in greater detail elsewhere herein, which permit membrane assembly 50 to mate with coil assembly 60 and coil assembly 60 to mate with baseplate assembly 80 without the need of a frame found in typical prior art speakers.

Figure 5:
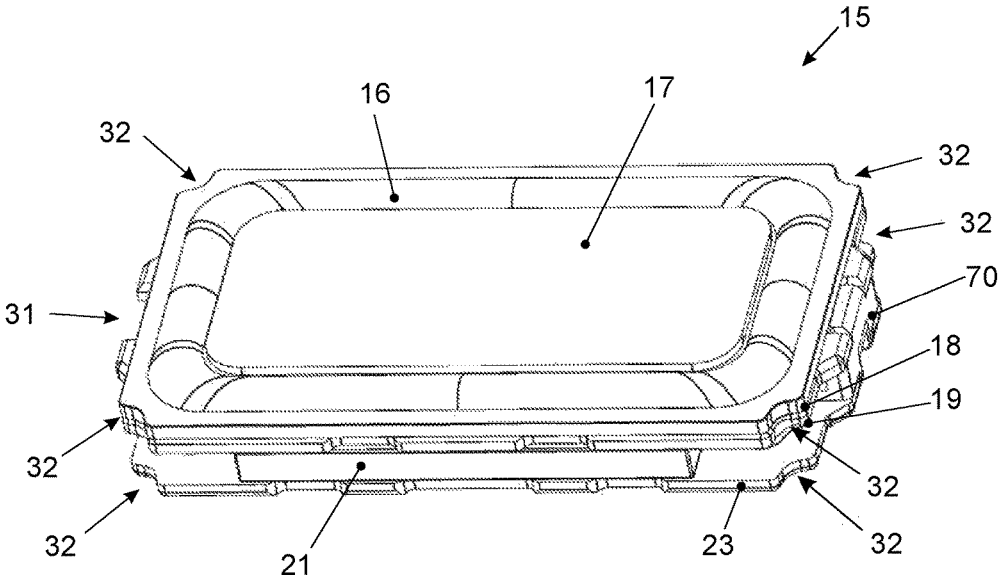
FIG. 5 shows a perspective side view of the assembled speaker according to the first embodiment of the invention shown in FIG. 3.

The membrane assembly 50 includes a membrane 16 and a ring plate assembly 52. Membrane 16 has a top side, bottom side, and a periphery. In various embodiments, membrane 16 may also include a plate 17 which aids in stabilizing membrane 16. Ring plate assembly 52 is affixed to the bottom side of membrane 16. Ring plate assembly 52 may include a distance ring 18 affixed to membrane 16 and a ring plate 19 affixed to distance ring 18. Ring plate assembly 52 further includes two or more ring plate assembly mating elements 31. The ring plate assembly mating elements 31 may comprise female structures, such as, for example, recesses, slots, holes, notches, etc. As shown in FIGS. 3 and 5, the ring plate assembly mating elements 31 comprise slots located on opposite sides of ring plate assembly 52. In other embodiments, for example, the ring plate mating elements 31 may comprise male structures, such as, for example, pins, ribs or tabs.

Coil assembly 60 includes a coil 26 and a pair of contact pad assemblies 70. Coil 26 has a top side, a bottom side, and first and second leads 25 extending from coil 26. The top side of coil 26 is affixed to the bottom side of membrane 16. Each of the pair of contact pad assemblies 70 includes a body portion 72 and a contact pad 27. Leads 25 of coil 26 are electrically connected to contact pads 27. The body portion 72 of each contact pad assembly 70 includes a first body mating element 30 and a second body mating element 29. The first and second body mating elements 30, 29 may comprise male structures, such as, for example, pins, ribs or tabs. The first body mating elements 30 may include a projection extending upward from body portion 72 and the second body mating elements 29 may include a projection extending downward from body portion 72. In other embodiments, for example, the first and second body mating elements 30, 29 may comprise female structures, such as, for example, recesses, slots, holes, notches, etc. In yet other embodiments, for example, the first body mating elements 30 may comprise male structures while the second body mating elements 29 may comprise female structures. In yet other embodiments, for example, the first body mating elements 30 may comprise female structures while the second body mating elements 29 may comprise male structures. As shown in FIGS. 3 and 5, the first body mating elements 30 comprise a tab which is adapted to mate with the slot of the ring plate assembly 52. Therefore, where ring plate assembly 52 includes female structures, the contact pad assemblies 70 include male structures adapted to mate with the female structures of ring plate assembly. Conversely, where ring plate assembly 52 includes male structures, the contact pad assemblies 70 include female structures adapted to mate with the male structures of ring plate assembly. Additionally, as shown in FIGS. 3 and 5, the second body mating elements 29 comprise a pair of pins extending downward from body portion 72.

Speaker 15 further includes a baseplate assembly 80 having a baseplate or pot plate 23, and a population of outer magnets 21 and a center magnet 22 affixed to baseplate 23. A top plate 24 is further affixed to center magnet 22. Ring plate assembly 52, pot plate 23 and top plate 24 forms magnetic field guide 20 which guides and focuses the magnetic field of magnets 21 and center magnet 22. Coil 26 is located between the population of outer magnets 21 and center magnet 22 and moves vertically therein.

Baseplate 23 includes two or more baseplate mating elements 28. The baseplate mating elements 28 may comprise male structures, such as, for example, pins, ribs or tabs. In other embodiments, for example, the baseplate mating elements 28 may comprise female structures, such as, for example, recesses, slots, holes, notches, etc. As shown in FIGS. 3 and 5, the baseplate mating elements comprise a pair of holes into which the pair of pins of the contact pad assemblies 70 are adapted to insert and mate. Therefore, where baseplate 23 includes female structures, the contact pad assemblies 70 include male structures adapted to mate with the female structures of baseplate 23. Conversely, where baseplate 23 includes male structures, the contact pad assemblies 70 include female structures adapted to mate with the male structures of baseplate 23.

When assembled, the two or more ring plate assembly mating elements 31 interface with the first body mating elements 30 of the pair of contact pad assemblies 70, and the second body mating elements 29 of the pair of contact pad assemblies 70 interface with the two or more baseplate mating elements 28 to align the membrane assembly 50, coil assembly 60, and baseplate 23. Advantageously there is no need for a frame to fix contact pads 27 as the mating elements 28, 29, 30, 31 of speaker 15 offer this functionality.

Figure 6:
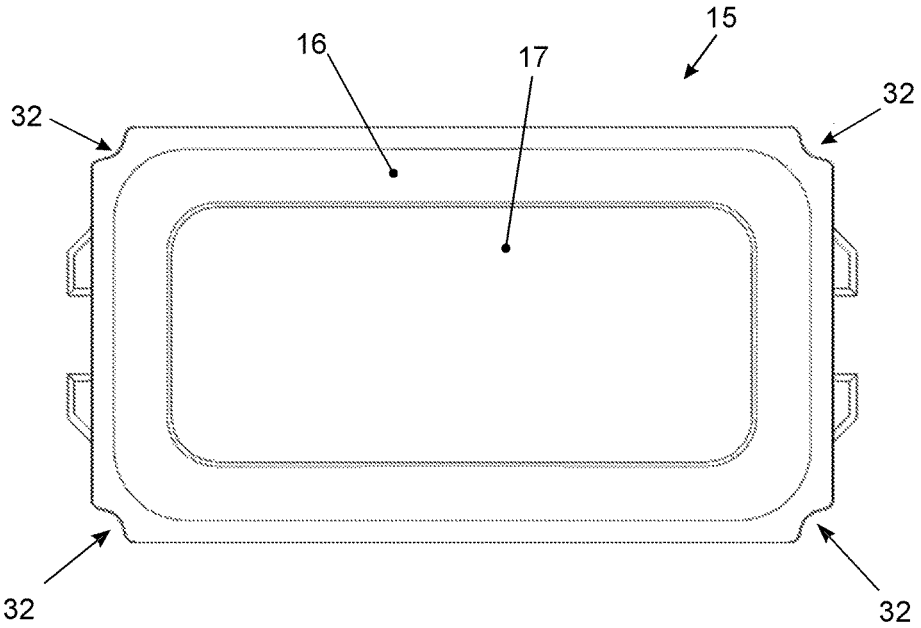
FIG. 6 shows a top view of the assembled speaker according to the first embodiment of the invention shown in FIG. 3.

FIG. 5 shows a perspective side view and FIG. 6 shows a top view of the assembled speaker 15 of FIG. 3. As shown, ring plate assembly 52 and baseplate 23 include a population of peripheral mating elements 32. Mating elements 32 may include notches, slots, recesses, or other indentations as known in the art. The mating elements 32 have been manufactured in a way such that they may be used to align the parts of speaker 15 during the assembly process. The mating elements 32 on ring plate assembly 52 are preferably in vertical alignment with the mating elements on baseplate 23. For example, corners of the rectangular speaker 15 include mating elements 32, such as notches in the distance ring 18, ring plate 19, and pot plate 23. Four pins, not shown in the Figures, are used to align the already prefixed membrane 16, coil 26, distance ring 18 and ring plate 19 with pot plate 23, to which magnets 21 and 22 are fixed. This construction of speaker 15 with mating elements 32 advantageously enables an exact alignment of the parts of speaker 15 during the assembly process without the need of a frame. Mating elements 32 further provide the advantage that they may be used to position and fix the speaker 15 within the mobile device with corresponding mating surfaces in the corners of the rectangular volume of the mobile device. While the mating elements 32 are shown as substantially the same at every corner of speaker, in various embodiments, the mating elements 32 may have different shapes and or sizes at one or more corners of the speaker 15 which may prevent improper installation of speaker into mobile device. That is, the mating elements 32 may be sized and shaped such that speaker 15 may only be installed into mobile device in the correct orientation. This may ease manufacture of mobile device.

As volume in the mobile device is very limited and often defined by the mobile device manufacturers, the performance of the speaker may be improved, for example, by larger magnets or a larger back volume realized in the volume the frame takes up in prior art micro speakers. The inventive construction without a frame therefore enables a better audio output of the speaker in a defined volume of a mobile device. Furthermore, the airflow within the back volume is improved in the speaker without a frame that would hinder the airflow.

In other embodiments of the invention, this frameless construction could be used to realize a receiver to transduce an acoustic sound into an electrical audio signal. This construction is particularly advantageous for rectangular audio transducers, but could be used for other form factors, for example, with transducers having five or six corners or oval or circular shapes as well.

Figure 7:
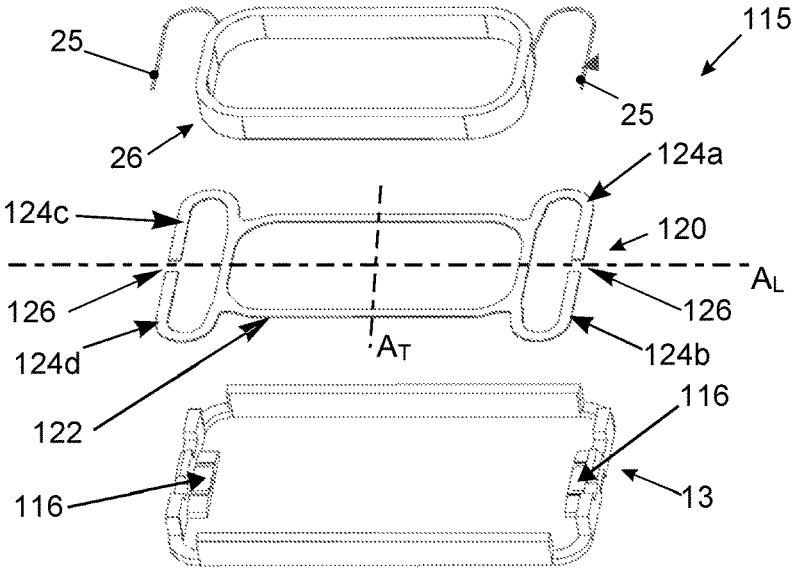
FIG. 7 shows an exploded perspective view of the relevant parts of a speaker according to a second embodiment of the invention.
Figure 8:
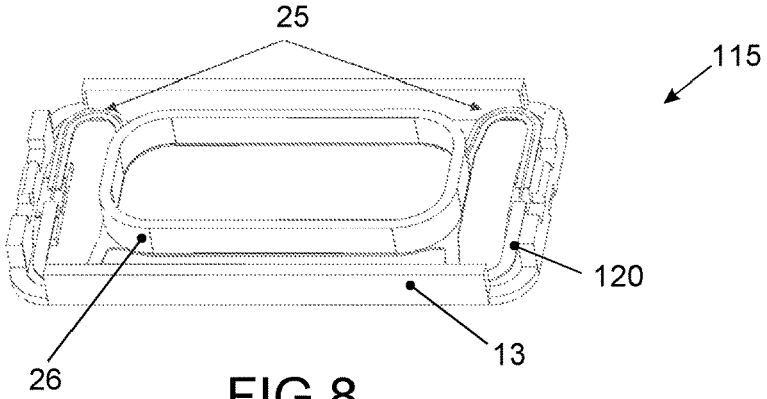
FIG. 8 shows a perspective side view of part of the speaker according to the second embodiment of the invention shown in FIG. 7.
Figure 9:
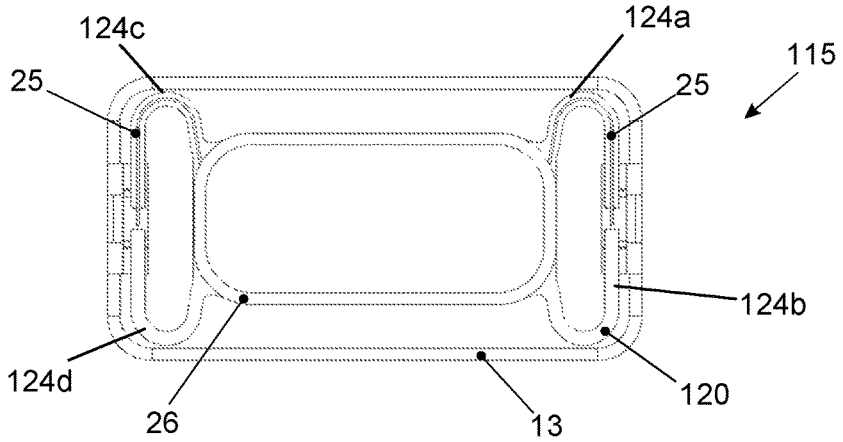
FIG. 9 shows a top view of part of the speaker according to the second embodiment of the invention shown in FIG. 7.

Another embodiment of a speaker 115 of the disclosure is illustrated in FIGS. 7-9 and is described below. Some features of one or more of speaker 115 and speaker 15, respectively, are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

FIG. 7 shows an exploded perspective view of part of a rectangular micro speaker 115 according to a second embodiment of the invention. FIG. 8 shows a perspective side view and FIG. 9 shows a top view of part of the speaker 115 of FIG. 7. As shown, micro speaker 115 comprises a frame 13 having contact pads 116, and a coil 26 having two electrical leads 25. Speaker 115 further comprises a support member 120 formed to mechanically support a coil 26 and its leads 25 to reduce the potential for damage of the leads 25. Leads 25 are electrically connected to the contact pads 116. As with the micro speaker 15 of FIG. 2, the two leads 25 form a short wire loop.

In an embodiment, the support member 120 is constructed to form a central loop portion 122 having a profile substantially matching the profile of the coil 26. That is, the central loop portion 122 has substantially the same shape as coil 26. The support member 120 further includes first and second lead supports 124*a*, 124*b* extending outward from a first end of central loop portion 122. First and second lead supports 124*a*, 124*b* may have substantially the same shape as lead 25. First and second lead supports 124*a*, 124*b* may be substantially symmetrical along longitudinal axis $A_L$. Additionally, in various embodiments, there may be a gap 126 separating the terminal ends of first and second lead supports 124*a*, 124*b*. Support member 120 additionally includes third and fourth lead supports 124*c*, 124*d* extending outward from a second end of central loop portion 122. Third and fourth lead supports 124*c*, 124*d* may have substantially the same shape as lead 25. Third and fourth lead supports 124*c*, 124*d* may be substantially symmetrical along longitudinal axis $A_L$ of coil 26. Additionally, in various embodiments, there may be a gap 126 separating the terminal ends of first and second lead supports 124*c*, 124*d*. First and second lead supports 124*a*, 124*b* and third and fourth lead supports 124*c*, 124*d* may be substantially symmetrical along transverse axis $A_T$ of coil 26.

Support member 120 may be glued with its four lead supports 124*a*, 124*b*, 124*c*, 124*d* affixed to frame 13 and with central loop portion 122 affixed to coil 26, as shown in FIG. 8. With coil 26 glued to support member 120, each of the leads 25 of coil 26 rest on and are supported by one of the four lead supports 124*a*, 124*b*, 124*c*, 124*d* (leads 25 shown on first and third lead supports 124*a*, 124*c*) between the coil 26 and the contact pad 116.

Support member 120 may be made from thin plastic or metal foil with appropriate mechanical and chemical characteristics to provide mechanical support, but on the other hand enable free and undistorted movement of coil 26 and the membrane of speaker 115 in a temperature range typical for micro speakers. Support member 120 may be made of a non-conductive material; however, if support member 120 is made from a metal or other electrically conductive foil, it should be electrically isolated from the coil 26, the leads 25 and the contact pads 116. Alternatively, the lead supports 124*a*, 124*b*, 124*c*, 124*d* of support member 120 which support the leads 25 can be electrically isolated from each other to prevent a short between the leads 25. Although only two leads 25 have to be mechanically supported by support member 120, it advantageously comprises four symmetric lead supports 124*a*, 124*b*, 124*c*, 124*d* to avoid any asymmetry in the vibration of the membrane.

Speaker 115 may have other parts (not shown) similar to those included in the prior art speaker 1 as shown in FIG. 1. For example, the micro speaker 115 may have a similar magnet system 5 with four magnets 6 arranged on the rectangular sides of the micro speaker 115, inside of the frame 13, and a magnet 7 arranged in the center of micro speaker 115. A magnet system 5 in micro speaker 115 may further comprise a top plate 9 fixed to magnet 7 and a ring plate 10, fixed to the top surfaces of magnets 6. A pot plate 11 may further be included and fixed to the bottom surfaces of magnets 6. The coil 26 of micro speaker 115 may be arranged in an air gap 12 between magnets 6 and magnet 7, and may be attached on its top surface to a membrane, such as the membrane 2 in prior art micro speaker 1. The finished construction of micro speaker 115 may or may not be similar to the construction of prior art micro speaker 1, and may take on other configurations of a magnet system and membrane.

Additionally, although shown in conjunction with frame 13, it will be understood that in various embodiments, support member 120 may be used in speaker 15 shown in FIGS. 3-6 without departing from the scope of the invention. That is, support member 120 may be used in the frameless construction described in conjunction with speaker 15. Thus, coil 26 of speaker 15 may be supported by support member 120 with central loop 122 supporting coil 26 and one or more lead supports 124*a*, 124*b*, 124*c*, 124*d* supporting leads 25 wherein the lead supports 124*a*, 124*b*, 124*c*, 124*d* may be affixed to contact pad assemblies 70.

Figure 10:
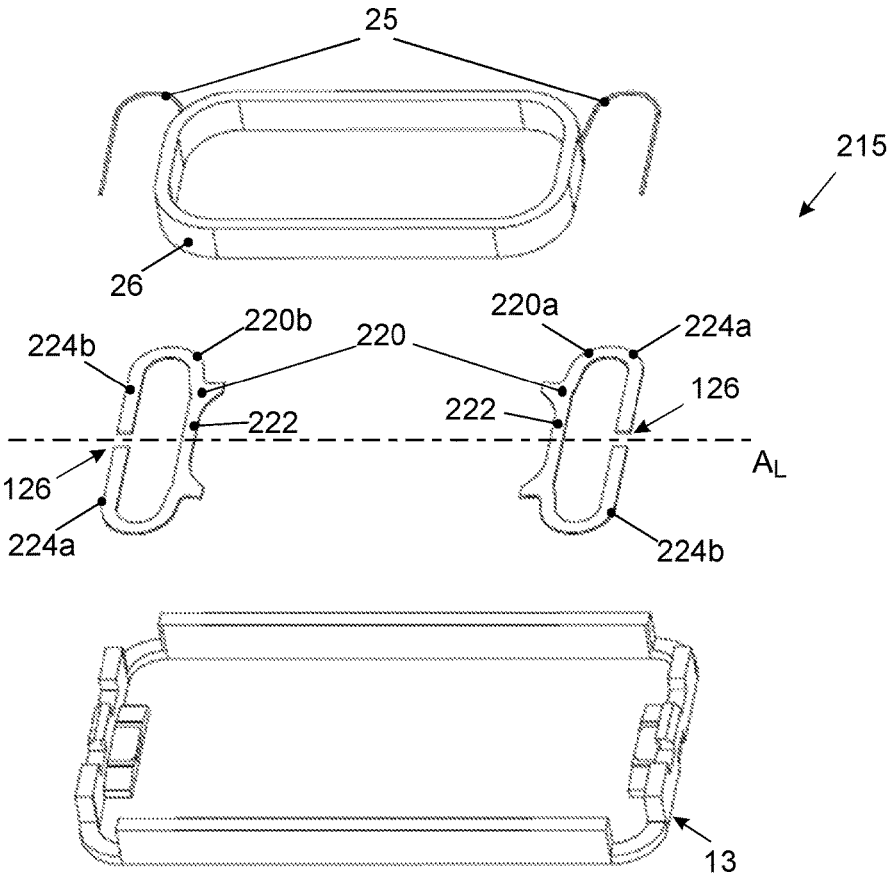
FIG. 10 shows an exploded perspective view of the relevant parts of a speaker according to a third embodiment of the invention.
Figure 11:
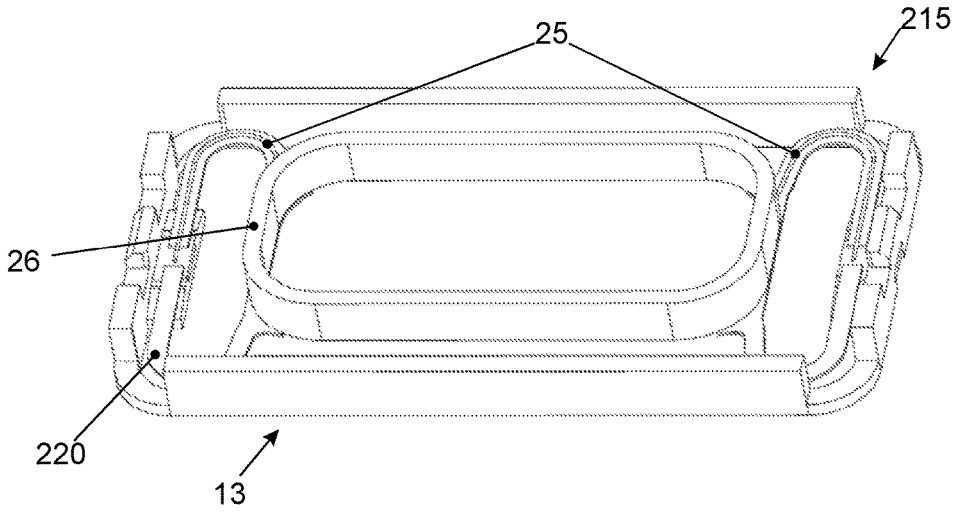
FIG. 11 shows a perspective side view of part of the speaker according to the third embodiment of the invention shown in FIG. 10.

Another embodiment of a speaker 215 of the disclosure is illustrated in FIGS. 10-11 and is described below. Some features of one or more of speaker 215 and speakers 15 and 115, respectively, are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

FIG. 10 shows an exploded perspective view of the relevant parts of a rectangular micro speaker 215 according to a second embodiment of the invention. FIG. 11 shows a perspective side view of part of the speaker 215 of FIG. 10. The embodiment of the invention shown in FIGS. 10 and 11 differs from the embodiment shown in FIGS. 7-9 in the form of support member 220 that is spilt-up in two parts. That is, support member 220 is similar to support member 120 except that it does not include central loop 122. This provides the advantage of less weight of the moving parts, coil 26 and the membrane, and, in the case of a support member 220 made of a metal foil, electrical isolation between the lead supports which support the leads 25.

Thus, support member 220 comprises two support member portions 220*a*, 220*b*. The two support member portions 220*a*, 220*b* may be identical and each include a transverse coil support portion 222 with first and second lead supports 224*a*, 224*b* extending outward from transverse coil support portion 222. First and second lead supports 224*a*, 224*b* may have substantially the same shape as lead 25. First and second lead supports 224*a*, 224*b* may be substantially symmetrical along longitudinal axis $A_L$. Additionally, in various embodiments, there may be a gap 126 separating the terminal ends of first and second lead supports 224*a*, 224*b*.

When affixed to coil 26 and lead 25, first and second lead supports 224*a*, 224*b* of support member portion 220*a* function substantially the same as first and second lead supports 124*a*, 124*b* of support member 120. Furthermore, when affixed to coil 26 and lead 25, first and second lead supports 224*a*, 224*b* of support member portion 220*b* function substantially the same as third and fourth lead supports 124*c*, 124*d* of support member 120.

Although shown in conjunction with frame 13, it will be understood that in various embodiments, support member 220 may be used in speaker 15 shown in FIGS. 3-6 without departing from the scope of the invention. That is, support member 220 may be used in the frameless construction described in conjunction with speaker 15. Thus, coil 26 of speaker 15 may be supported by support member 220 with transverse coil support portions 222 supporting coil 26 and one or more lead supports 224*a*, 224*b* of support member portions 220*a*, 220*b* supporting leads 25 wherein the lead supports 224*a*, 224*b* of support member portions 220*a*, 220*b* may be affixed to contact pad assemblies 70.

Figure 12:
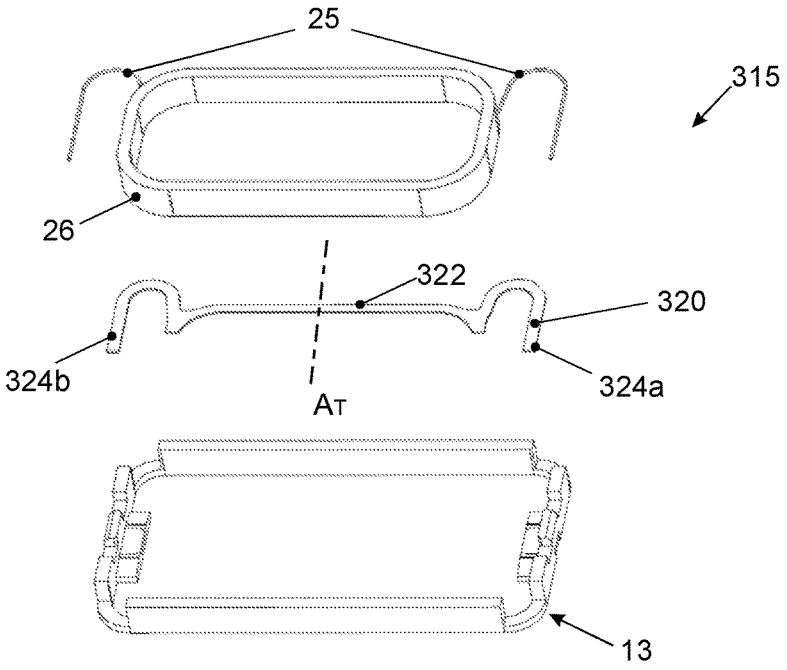
FIG. 12 shows an exploded perspective view of the relevant parts of a speaker according to a fourth embodiment of the invention.
Figure 13:
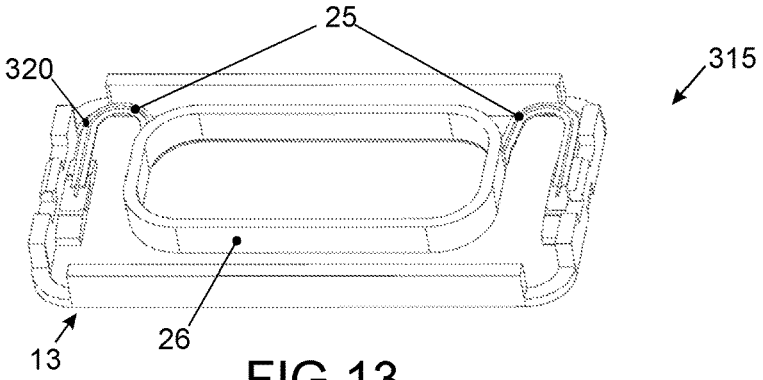
FIG. 13 shows a perspective side view of part of the speaker according to the fourth embodiment of the invention shown in FIG. 12.
Figure 14:
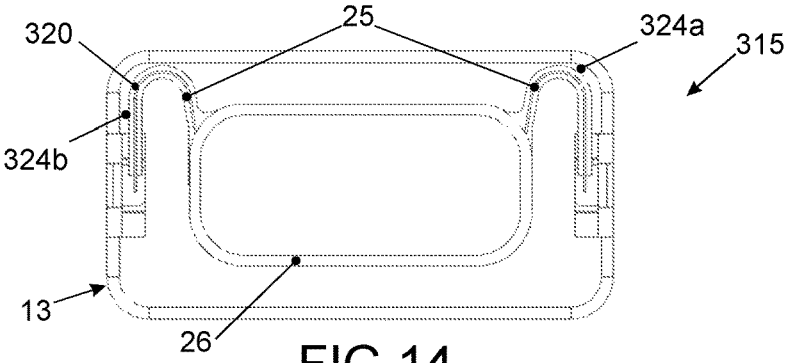
FIG. 14 shows a top view of part of the speaker according to the fourth embodiment of the invention shown in FIG. 12.

Another embodiment of a speaker 315 of the disclosure is illustrated in FIGS. 12-14 and is described below. Some features of one or more of speaker 315 and speakers 15, 115 and 215, respectively, are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

FIG. 12 shows an exploded perspective view of the relevant parts of a rectangular micro speaker 315 according to a third embodiment of the invention. FIG. 13 shows a perspective side view and FIG. 14 shows a top view of part of the speaker 315 of FIG. 12. The embodiment of the invention shown in FIGS. 12-14 differs from the embodiment shown in FIGS. 7-9 in the form of support member 320. Support member 320 is realized in one part, but only in the half area where leads 25 need mechanical support. This provides the advantage of less weight of the moving parts, coil 26 and the membrane.

Support member 320 includes a longitudinal coil support portion 322 having first and second opposite ends with first and second lead supports 324*a*, 324*b* extending therefrom. First and second lead supports 324*a*, 324*b* may have substantially the same shape as lead 25. First and second lead supports 324*a*, 324*b* may be substantially symmetrical along transverse axis $A_T$.

When affixed to coil 26 and lead 25, first and second lead supports 324*a*, 324*b* of support member 322 function substantially the same as first and third lead supports 124*a*, 124*c* of support member 120. Thus, support member 320 is substantially the same as support member 120 if support member 120 were cut along longitudinal axis $A_L$ (FIG. 7).

Although shown in conjunction with frame 13, it will be understood that in various embodiments, support member 320 may be used in speaker 15 shown in FIGS. 3-6 without departing from the scope of the invention. That is, support member 320 may be used in the frameless construction described in conjunction with speaker 15. Thus, coil 26 of speaker 15 may be supported by support member 320 with longitudinal coil support portion 322 supporting coil 26 and first and second lead supports 324*a*, 324*b* supporting leads 25 wherein first and second lead supports 324*a*, 324*b* may be affixed to contact pad assemblies 70.

A support member to mechanically support the leads of the coil may be fixed to the bottom side of a coil, opposite the membrane, as shown in the three embodiments in FIGS. 7-14. The support member may also be fixed to the top side of the coil, between the coil and the membrane, or there may be two portions of the support member fixed on opposite sides of the coil. The support member may be designed to function as a damper, in particular a B-damper, as well. It may be used to adjust or optimize the movement of the coil and membrane to achieve better acoustic performance.

Although several embodiments of this invention have been described above with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the invention. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. An audio transducer comprising:

a membrane assembly, the membrane assembly comprising:

a membrane having a top side and a bottom side and a periphery; and a ring plate assembly affixed to the periphery of the bottom side of the membrane, the ring plate assembly having two or more ring plate assembly mating elements;

a coil assembly, the coil assembly comprising:

a coil having a top side and a bottom side and a first lead and a second lead extending from the coil, the top side of the coil being affixed to the bottom side of the membrane; and a pair of contact pad assemblies, each contact pad assembly having:

a body portion and a contact pad affixed to the body portion;

wherein the body portion includes a first body mating element and a second body mating element; and a baseplate having two or more baseplate mating elements;

wherein, when assembled, the two or more ring plate assembly mating elements interface with the first body mating elements of the pair of contact pad assemblies, and the second body mating elements of the pair of contact pad assemblies interface with the two or more baseplate mating assemblies to align the membrane assembly, coil assembly, and baseplate.

2. The audio transducer of claim 1, wherein the ring plate assembly mating elements comprise recesses.

3. The audio transducer of claim 1, wherein the baseplate mating elements comprise recesses.

4. The audio transducer of claim 1, wherein the first body mating element comprises a projection extending upward from the body portion and wherein the second body mating element comprises a projection extending downward from the body portion.

5. The audio transducer of claim 1, wherein the ring plate assembly mating elements comprise a female structure and wherein the first body mating elements comprise a male structure that is adapted to mate with the female structure of the ring plate assembly mating elements.

6. The audio transducer of claim 1, wherein the base plate mating elements comprise a female structure and wherein the second body mating elements comprise a male structure that is adapted to mate with the female structure of the baseplate mating elements.

7. The audio transducer of claim 1, wherein the ring plate assembly mating elements comprise a slot and wherein the first body mating elements comprise a tab that is adapted to mate with the slot of the ring plate assembly.

8. The audio transducer of claim 1, wherein the base plate mating elements comprise a pair of holes and wherein the second body mating elements comprise a pair of pins that are adapted to mate with the pair of holes of the baseplate.

9. The audio transducer of claim 1, wherein the ring plate assembly and the baseplate include a population of peripheral mating elements.

10. The audio transducer of claim 9, wherein the population of peripheral mating elements on the ring assembly are in vertical alignment with the population of peripheral mating elements on the baseplate.

11. The audio transducer of claim 1, wherein the baseplate further comprises a population of outer magnets and a center magnet, the population of outer magnets and the center magnet affixed to the baseplate.

12. The audio transducer of claim 11, wherein the coil is located between the population of outer magnets and the center magnet.

13. The audio transducer of claim 1, wherein the ring plate assembly comprises a distance ring and a ring plate.

14. The audio transducer of claim 1, wherein the coil assembly further comprises a support member affixed to the bottom of the coil and wherein each coil lead is supported by the support member.

15. The audio transducer of claim 14, wherein the support member comprises:

a central loop portion having a first end and a second end opposite the first end;

a first lead support extending outward from the first end; and a second lead support extending outward from the second end;

wherein the central loop portion has substantially the same shape as the coil, the first lead support has substantially the same shape as the first lead, and the second lead support has substantially the same shape as the second lead.

16. The audio transducer of claim 15, wherein the first lead support member is affixed to one of the pair of contact pad assemblies and the second lead support member is affixed to the other of the pair of contact pad assemblies.

17. The audio transducer of claim 14, wherein the support member is non-conductive.

18. The audio transducer of claim 14, wherein the support member is electrically isolated from the coil and the leads.

19. The audio transducer of claim 14, wherein the support member has substantially the same shape as a lead of the coil.

20. The audio transducer of claim 1, wherein the coil assembly further comprises a first support member affixed to the bottom of the coil to support the first lead, and a second support member affixed to the bottom of the coil to support the second lead.

* * * * *